US005322108A

United States Patent [19]

Hoffman

[11] Patent Number: 5,322,108

[45] Date of Patent: Jun. 21, 1994

[54] TWO SECTION SLAT FOR ROLL-TYPE SHUTTERS

[76] Inventor: Robert E. Hoffman, 5618 Riviera Dr., Coral Gables, Fla. 33146

[21] Appl. No.: 131,001

[22] Filed: Oct. 4, 1993

[51] Int. Cl.[5] ..... E06B 3/06

[52] U.S. Cl. ..... 160/236; 160/235

[58] Field of Search ..... 160/236, 235, 133, 229.1

[56] References Cited

U.S. PATENT DOCUMENTS 4,792,894 11/1990 Machill ..... 160/236 X

FOREIGN PATENT DOCUMENTS 2925635 1/1981 Fed. Rep. of Germany ..... 160/236
3206997 9/1983 Fed. Rep. of Germany ..... 160/236
3335134 4/1985 Fed. Rep. of Germany ..... 160/236
3516328 11/1986 Fed. Rep. of Germany ..... 160/236
2531137 2/1984 France ..... 160/236
2555243 5/1985 France ..... 160/236

*Primary Examiner*—Blair M. Johnson
*Attorney, Agent, or Firm*—Harness, Dickey & Pierce

[57] ABSTRACT

A two-section slat for use in a roll-type shutter is formed of a channel-shaped extrusion section having a hook formation at its upper end and a receiving channel for the next slat hook along its lower edge. The channel is overlapped by a cover section which is engaged and interlocked with the channel section at the upper edge, lower edge and in the central portion of the cover section. The two sections are formed with interlocking means which hold the two sections together under resilient pressure to form a hollow, substantially rigid, flat bar. The cover section may have a preselected color or texture which differs from the color and texture of the channel section. Thus, the slat, having two different colors or textures can match the decor of a interior room of a dwelling while also matching the appearances of numerous shutters exposed to view on the exterior of the building.

8 Claims, 1 Drawing Sheet

FIG 1
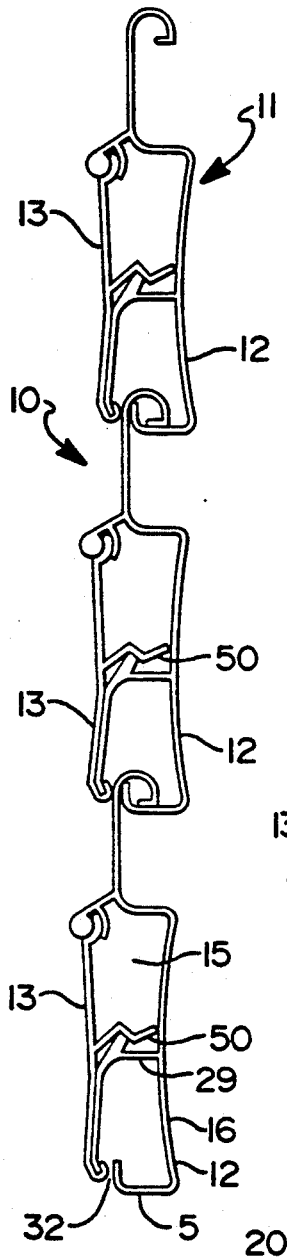
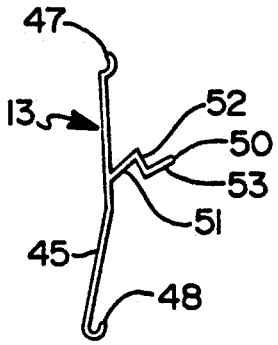
FIG 2
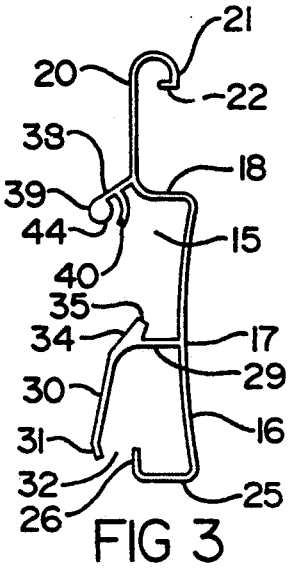
FIG 3
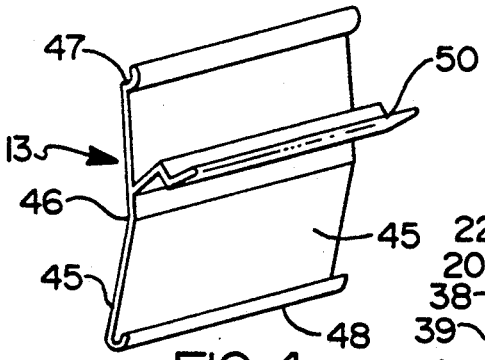
FIG 4
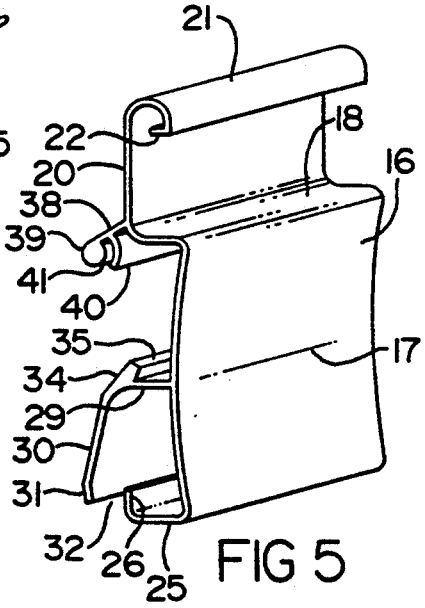
FIG 5
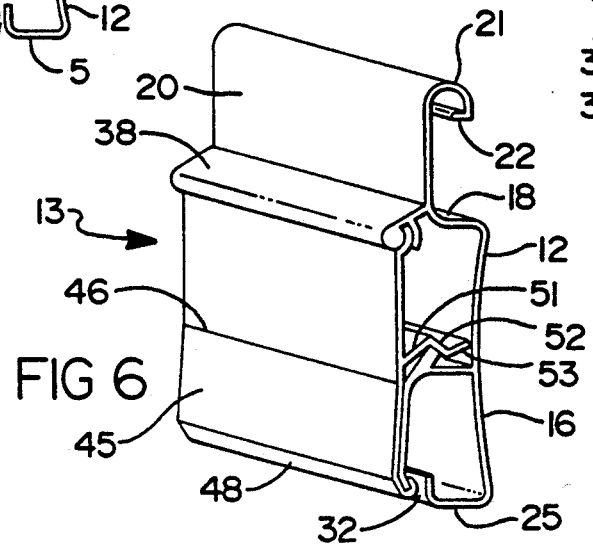
FIG 6

TWO SECTION SLAT FOR ROLL-TYPE SHUTTERS

BACKGROUND OF INVENTION

This invention relates to an improved slat for use on roll-type shutters or blinds. Roll-type shutters are typically formed of a substantial number of horizontally elongated slats which are connected together, one above the other, to form a complete panel when the shutter is extended. One common form of shutter slat is formed of an aluminum or plastic extrusion made in a box-like cross-sectional configuration. The extrusion includes a hook configuration along the slat upper edge and a socket receiving the hook of the next slat along the slat lower edge for interconnecting adjacent slats one above the other.

Typically, extruded slats are made of a single aluminum or plastic extrusion. However, slats have been made of two separate sections which were fastened together to form a single box-like slat construction. Where the slats are formed of a single extrusion, the visual appearance on both sides of the shutter or blind, which is made of assembled slats, is the same. For example, if the slats are formed of aluminum which is painted with a particular color, both sides of the extended panel are the same.

There are times, however, where it is desirable to produce a blind or shutter panel which has an interior surface that is different than the appearance of the panel exterior surface to match a desired decor of a building. For example, it may be desirable to provide a different color and texture on the interior surface of the panel so that a large number of panels, covering a large number of windows of a building all appear to be the same from the outside of the building, while the interior surfaces are selectively matched to the decor of a particular room in which they are placed.

Examples of prior roll-type shutters with extruded, hollow or box-type slats are illustrated in U.S. Pat. No. 4,343,340 issued Aug. 10, 1982 to Paule; U.S. Pat. No. 4,428,218 issued Jan. 31, 1984 to LaRocca; and U.S. Pat. No. 4,601,953 issued Jul. 22, 1986 to Haffer. An example of a prior two-section slat formed of an aluminum extrusion with a separate, connected wood or extruded plastic section is illustrated in U.S. Pat. No. 4,173,247 issued Nov. 6, 1979 to Piana.

The invention herein relates to improvements to the types of slats mentioned above and particularly to the type of slat formed of two sections of two different materials. The improvements provide an inexpensive slat construction of the two-section type but, which can be more rapidly and easily assemblied.

SUMMARY OF INVENTION

The invention herein relates to forming a roll-type shutter slat out of two separate extrusions which are mechanically secured together to form a box-like or hollow slat construction which is rigid and whose opposite surfaces can differ in color or texture or in other appearance features. Thus, the invention contemplates forming one extrusion in the shape of a horizontally extending open channel with a hook-like configuration formed on one edge and a hook receiving portion formed on its opposite edge for interconnecting adjacent slats, edge-to-edge. A second, cover strip, extrusion is shaped to cover the open channel and mechanically interlock with upper and lower portions of the channel extrusion and to also interlock with a central flange-like connector formed in the middle of the channel. Thus, the two extrusions are fastened together mechanically and can be easily assembled by mechanical pressure without the need of additional fasteners.

One object of this invention is to provide a two-section slat having an inner section whose color and texture may be varied from that of the outer section. The two sections are formed of aluminum or plastic extrusions that mechanically interlock to form a unitary box-like slat assembly upon being pressed together.

A further object of this invention is to provide a simplified connection system for interconnecting aluminum and plastic extruded sections, which form a box-type slat, by utilizing the inherent resilience of the extrusions to interlock and frictionally hold the two sections together. The assembled slat sections can handle substantial forces which may be applied to the slats during rolling the blinds or shutters up or down or which may be applied by wind pressures or by other physically applied loads.

Another object of this invention is to provide a shutter slat which can be made and stored as two separate extruded sections of different colors and textures, and which sections can be assembled rapidly upon request by a consumer for specific interior and exterior panel surfaces. For example the consumer may want to match the interior decor interior of a room while providing an exterior shutter appearance that matches the exterior appearances of the shutters in other parts of particular building.

These and other objects and advantages of this invention will become apparent upon reading the following description, of which the attached drawings form a part.

DESCRIPTION OF DRAWING

FIG. 1 is a end view, with conventional slat end caps or closures removed, of several slats interconnected together to form a portion of roll-type shutter panel.

FIG. 2 is an end view of the inner or cover section of the shutter slat.

FIG. 3 is an end view of the extruded outer or base section of the slat.

FIG. 4 is a fragmentary, perspective view of the exterior surface of the wall of the cover section.

FIG. 5 is a fragmentary, perspective view of an end portion and exterior wall of the extruded base section of the slat.

FIG. 6 is a fragmentary, perspective, end view of the slat with the base and cover sections interlocked and showing the interior surface of the wall of the cover section.

DETAIL DESCRIPTION

Referring to the drawings, FIG. 1 illustrates a portion of a roll-type shutter panel 10 which is formed of a substantial number of horizontally arranged slats 11 that are joined together edge-to-edge. Each of the slats is formed of two sections, that is, a base section 12 and a cover section 13.

The base section 12 is preferably formed of an aluminum extrusion, although a plastic extrusion could be used. If made of aluminum, the base section may be painted as is conventional for aluminum slats. The base section is formed with a channel 15, which has a generally flat base 16. However, the base 16 has a central bend line 17 extending longitudinally along its full length so that the base is slightly V-shaped in cross-section.

The channel also has an integral, upper wall 18 which is bent into an upwardly extending hook flange 20. The upper end of the hook flange has a downwardly bent hook 21. Also, the hook terminates in a narrow flange 22.

An integral, lower wall 25 defines the lower part of the channel. The lower wall is bent upwardly to form a hook engaging flange 26. As will be described later, the hook 21 of one slat fits over the hook engaging flange 26 of the slat above it so that the hook flange 22 is arranged between the flange 26 and the channel base 16.

A central wall 29 is integrally formed on the base 16, as illustrated, for example, in FIGS. 3 and 5. The central wall may be arranged at the bend 17 or may be arranged elsewhere along the surface of the base, depending upon the strength requirements of the slat. The central wall divides the channel into upper and lower cavity portions. A depending cover strip 30 is integrally formed with the free end of the central wall 29 and this cover strip extends downwardly over the channel lower cavity portion. Preferably, the cover strip extends angularly outwardly of the channel (see FIG. 3) and terminates in a bent lower edge strip 31. This lower edge strip is spaced from the hook engaging flange 26 to provide a gap 32 through which the hook of the next lower slat may be passed.

The central wall free edge also is provided with an upper integral flange 34 which is angled towards the base 16 and which terminates in a beveled or angled, upper engagement edge 35.

The outer edge of the channel upper wall 18 is provided with an integral, outwardly and downwardly extending upper fastening flange 38 whose free end portion is bifurcated. This provides an outer arm 39 and an inner arm 40 between which a groove 41 is formed. The outer arm is preferably rounded in cross-section to form a round edge bead.

The foregoing construction can be easily extruded from aluminum or a suitable plastic material in long lengths which may be cut to the particular lengths needed for slats of a particular width shutter.

The second or cover section 13 is formed of an extruded strip 45 which is substantially flat and which is of a sufficient length and width to cover the channel 15 of the base section. The strip 45 is preferably formed of an extruded plastic material. The strip may have a longitudinally extending central bend 46 so that the strip is actually slightly V-shaped in cross-section.

The upper edge of the strip 45 is formed in a C-shaped bend 47 of a size and shape to fit into the groove 41 of the upper wall flange 38 and to receive the edge bead 39.

The lower edge of the strip 45 is provided with a return bend 48 which forms an edge channel for overlapping or receiving the bent lower edge 31 formed on the cover strip 30 of the base section.

The cover section 13 also includes an integral central Z-shaped flange 50. This flange is bent into an inner leg portion 51 which extends over the flange 34 of the central wall of the base section. The web 52 of the Z-shaped flange engages, in substantial face-to-face contact, the beveled edge 35 of the flange 34. The outer leg portion 53 of the flange 50 engages against the base surface 16.

Because the extrusions, whether made of aluminum or of plastic material, are inherently slightly resilient, the cover section can be pressed against the base section to interlock the two sections together. For example, if a customer selects a particular color cover section to be used with a standard base section, the selected cover section may be positioned over the channel 15 of the base section. Then, the lower bent groove 48 in the strip 45 can be engaged around the lower flange 31 of the base section. With that, the cover section can be moved against and mechanically pushed into the base section. The inherent springingness of the Z-shaped flange 50 of the cover section will cause that flange to spring over and interlock with the flange 34 on the central wall of the base section. Then, the outer most portion of the Z-flange, that is, the portion 53 will resiliently press against the base 16 for resiliently holding the parts together. Simultaneously, the upper C-shaped edge 47 of the strip will receive the bead 39 and interlock with the groove 41 along the flange 38 on the upper wall of the base section.

As can be seen, assembly of the two sections can be made rapidly and with minimal labor so that the consumer may choose a particular color or texture for the interior surface of the shutter with minimal expense. Moreover, the two separate sections with the channel space between them form a dead air space which acts as insulation. Also, the box-like cross-section produces a rigid bar-like construction of considerable strength. The resilient interlocking of the parts increases that strength. Further, the lower portion of the cover section 45 engages the depending cover strip 30 of the base section. This substantial surface-to-surface contact forms a double thickness wall which rigidifies the slat construction.

This invention may be further developed in accordance with the scope of the following claims. Accordingly, it is desired that the foregoing description be read as being illustrative of an operative embodiment of this invention and not in a strictly limiting sense.

Having fully described an operative embodiment, it is now claimed:

1. A two section roll-type shutter slat comprising:

an extruded base section having a channel shape cross-section formed of a generally flat, normally vertically arranged base with integral upper and lower walls extending from said base;

a free edge of said upper wall having an integral upwardly extending hook flange whose upper, free end is bent into a downwardly opening hook; and a free edge of said lower wall having an integral, upperwardly extending hook-engaging flange arranged to fit into the hook of a substantially identical next lower slat located beneath, and thereby depending from, the above-mentioned slat;

and the free edge of said upper wall also having an integral, upper fastening flange extending generally outwardly relative to said base and terminating in a securement edge;

a central wall formed integral with the base of the channel generally dividing the channel into an upper cavity defined by an upper portion of the channel base, upper wall and central wall and a lower cavity defined by the channel base, lower wall and central wall;

a free edge of the central wall having an integral, downwardly extending cover strip which covers the lower cavity and terminates in a lower edge that is spaced from said lower channel flange, with the space being sufficient to receive the upper end of the upwardly extending hook flange of the next lower slat;

and the free edge of the central wall also having an integral flange extending upwardly into said upper cavity and terminating in an upper engagement edge;

a cover section formed of an extruded strip having a cross-sectional height dimensioned to cover the channel of the base section, and having an upper edge shaped to interlock with said upper fastening flange securement edge and a lower edge formed to overlap the cover strip free edge, with the cover section overlapping and being in substantial face-to-face contact with the cover strip;

and the cover section having an integral, central flange which extends over and engages with said central wall flange;

whereby different color and surface texture cover sections may be selectively engaged with a slat base section for presenting selective decorative surfaces on one face of a shutter formed of a number of identical interconnected slats.

2. A two-section, roll type shutter slat as defined in claim 1 and said cover section central flange being generally Z-shaped in cross-section and with one leg of the Z extending over said central wall flange, with a web of the Z-shaped flange overlapping and engaging against the free edge of the central wall upper engagement edge and a remaining leg of this Z-shaped flange extending towards and engaging against said channel base above the channel central wall and with the Z-shaped flange interlocking the cover section to the base section.

3. A two-section, roll-type shutter slat as defined in claim 2, and including a groove formed on the securement edge of the upper fastening flange for receiving the upper edge of the cover strip for interlocking the two together.

4. A two-section, roll-type shutter slat as defined in claim 3, and including a free end of the securement edge being bifurcated into an outer arm and an inner arm to form the groove between the two arms, which groove extends the length of the base section.

5. A construction as defined in claim 4, and including the upper edge of the cover section being bent into an approximately C-shape cross-section for fitting into said groove and for receiving the free end of the outer arm.

6. A two section roll-type shutter slat as defined in claim 1, and including the lower edge of the cover section being bent into an upwardly opening channel which is bent around and receives a lower free edge of said cover strip for interengaging the cover strip and the cover section.

7. A construction as defined in claim 1, and including the base and the cover section each being bent longitudinally at approximately their centers to form a wide V-shaped in cross-section arrangement extending oppositely to each other.

8. A construction as defined in claim 7 above, and including the cover strip of the base section extending downwardly and outwardly, at an acute angle relative to the base and being in substantial face to face engagement with the lower portion of the cover section and with the two sections being mechanically interlocked by the interengaged upper and lower edges and central flange of the cover striped aided by the resilient pressure of the interlocked parts.

* * * * *